US006607225B1

(12) United States Patent
Lai

(10) Patent No.: US 6,607,225 B1
(45) Date of Patent: Aug. 19, 2003

(54) STRUCTURE OF STAINLESS COMPOSITE CHOPSTICK

(76) Inventor: Yin-Chu Lai, No. 378, Pao-Bou Rd., Changhua (TW)

( * ) Notice: Subject to any disclaimer, the term of this patent is extended or adjusted under 35 U.S.C. 154(b) by 0 days.

(21) Appl. No.: 10/083,601

(22) Filed: Feb. 27, 2002

(51) Int. Cl.[7] ..... A47G 21/10
(52) U.S. Cl. ..... 294/1.1
(58) Field of Search ..... 294/1.1, 5.5, 58; 30/322, 123, 124, 142, 150, 329, 340; D7/642, 643, 644

(56) References Cited

U.S. PATENT DOCUMENTS

| | | | | | |
|---|---|---|---|---|---|
| 5,056,841 | A | * | 10/1991 | Yong | 294/1.1 |
| 5,431,465 | A | * | 7/1995 | Shibata | 294/1.1 |
| 2002/0096896 | A1 | * | 7/2002 | Lai | 294/58 |

FOREIGN PATENT DOCUMENTS

| | | | | |
|---|---|---|---|---|
| CA | 2060303 | * | 7/1993 | 294/1.1 |
| JP | 3170114 | * | 7/1991 | 294/1.1 |
| JP | 404215712 | * | 8/1992 | 294/1.1 |
| JP | 406062945 | * | 3/1994 | 294/1.1 |
| JP | 410276884 | * | 10/1998 | |
| JP | 411244118 | * | 9/1999 | |
| JP | 2001197994 | * | 7/2001 | |

* cited by examiner

*Primary Examiner*—Christopher P. Ellis
*Assistant Examiner*—Paul T. Chin
(74) *Attorney, Agent, or Firm*—Troxell Law Office PLLC

(57) ABSTRACT

A structure of any of a pair of stainless steel composite chopsticks, the chopstick is comprised of a main body and a stainless steel metallic sleeve portion combined with each other in injection molding. The chopstick is characterized by: the sleeve portion has a flared opening in connecting with the main body, the opening is located nearly at the middle of the length of the chopstick to be formed, and is provided on the periphery thereof with at least one hole for combination during fabricating the main body by injection molding. The main body can be given a particular pattern; thereby, the two kinds of materials for the chopstick can be firmly combined with each other, and the hardness of the chopstick can be increased. The main body can be, more beautiful by providing the particular pattern and the sleeve portion.

1 Claim, 6 Drawing Sheets

Prior Art Fig. 1

STRUCTURE OF STAINLESS COMPOSITE CHOPSTICK

BACKGROUND OF THE INVENTION

1. Field of the Invention

The present invention is related to an improved structure of any of a pair of stainless steel composite chopsticks, and especially to a structure that can increase strength and hardness of chopsticks used as tableware.

2. Description of the Prior Art

Conventional chopsticks are rods of round or square sectionally; or are rods of which the upper sections are made round while the lower sections are made conical, these sections are made of different materials such as those chosen from plastic, wood or stainless steel. Chopsticks made of wood can be used as washing free chopsticks, they can be discarded after using, but this mode is wasteful and damageable to environmental conservation; if used chopsticks are used again after washing, by virtue that wood is subjected to breeding of mould, the sections for picking up food of the chopsticks directly contact the food may have toxin therein, and it is worriable that health of a person may be damaged by using the chopsticks.

A conventional chopstick structure is depicted in FIG. 1, it is improved against the above stated defects, a slipping-proof sleeve is provided thereon; this can not only get rid of the probability of damage to environmental conservation and toxin of mould, but also get rid of the defect of easiness of slipping off of food from the stainless steel chopsticks. However, it can be seen from the drawing that the connecting mode of the chopstick is, the slipping-proof sleeve is slipped over the thinner rod portion on the front end of the chopstick and has a uniform diameter. By this mode, the point where the bearing force is the largest is the joint of the two kinds of materials of the chopstick; thereby, the chopstick is subjected to breaking at the end "A" of the slipping-proof sleeve by unsuitable exerting of a force, and after using for a period of time, the slipping-proof sleeve may be loosened and drop off from the chopstick, thereby, this structure is not desired.

In view of this, the inventor studied with experiments and developed the present invention that is firmer against dropping structurally, and that can be held conveniently and is good esthetically.

SUMMARY OF THE INVENTION

The primary object of the present invention is to provide a structure of stainless steel composite chopstick which is firmer in combination, has larger bearing strength, and can prevent two kinds of different materials thereof from dropping.

The secondary object of the present invention is to provide a structure of stainless steel composite chopstick that is good esthetically.

To achieve the above stated objects, any of a pair of chopsticks of the present invention is comprised of a stainless steel sleeve portion and a main body combined with each other in injection molding. The chopstick is characterized by: the sleeve portion has a flared opening in connecting with the main body, the opening of the sleeve portion is located nearly at the middle of the length of the chopstick to be formed, and is provided on the periphery thereof with at least one hole for combining during fabricating the main body by injection molding. The main body can be given a particular pattern; thereby, the two kinds of materials for the chopstick can be firmly combined with each other against dropping, and hardness of the chopstick can be increased. The main body can be more beautiful by providing the particular pattern and the sleeve portion.

The present invention will be apparent in its particular structural and other features after reading the detailed description of the preferred embodiments thereof in reference to the accompanying drawings.

DETAILED DESCRIPTION OF THE PREFERRED EMBODIMENT

Figure 1:
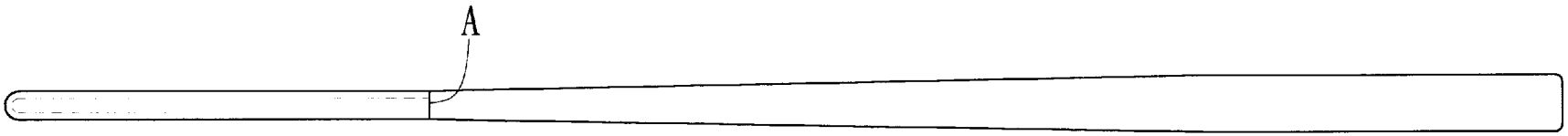
FIG. 1 is a plane view of a conventional composite chopstick.
Figure 2:
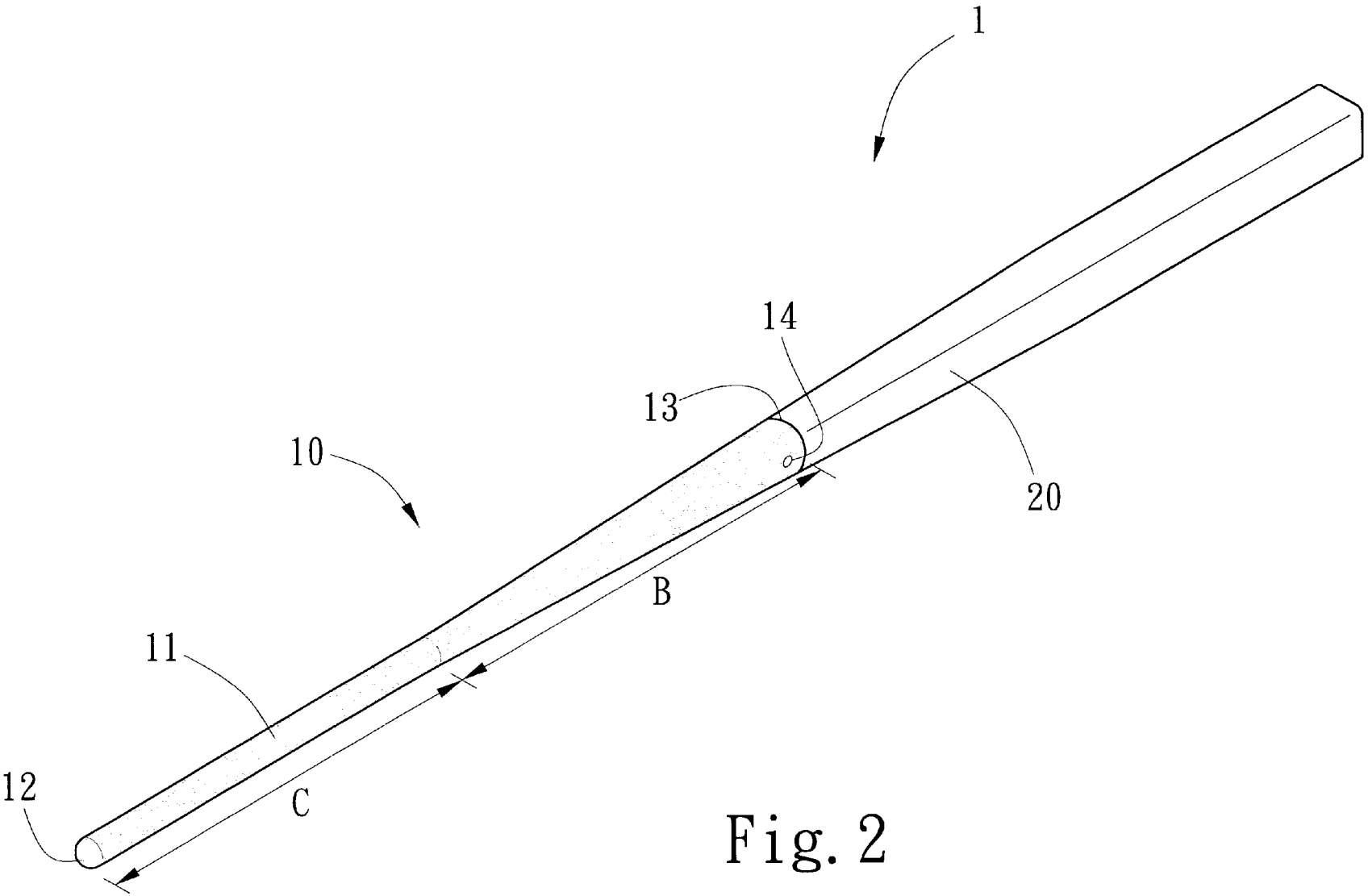
FIG. 2 is a perspective view of an embodiment of the present invention.
Figure 3:
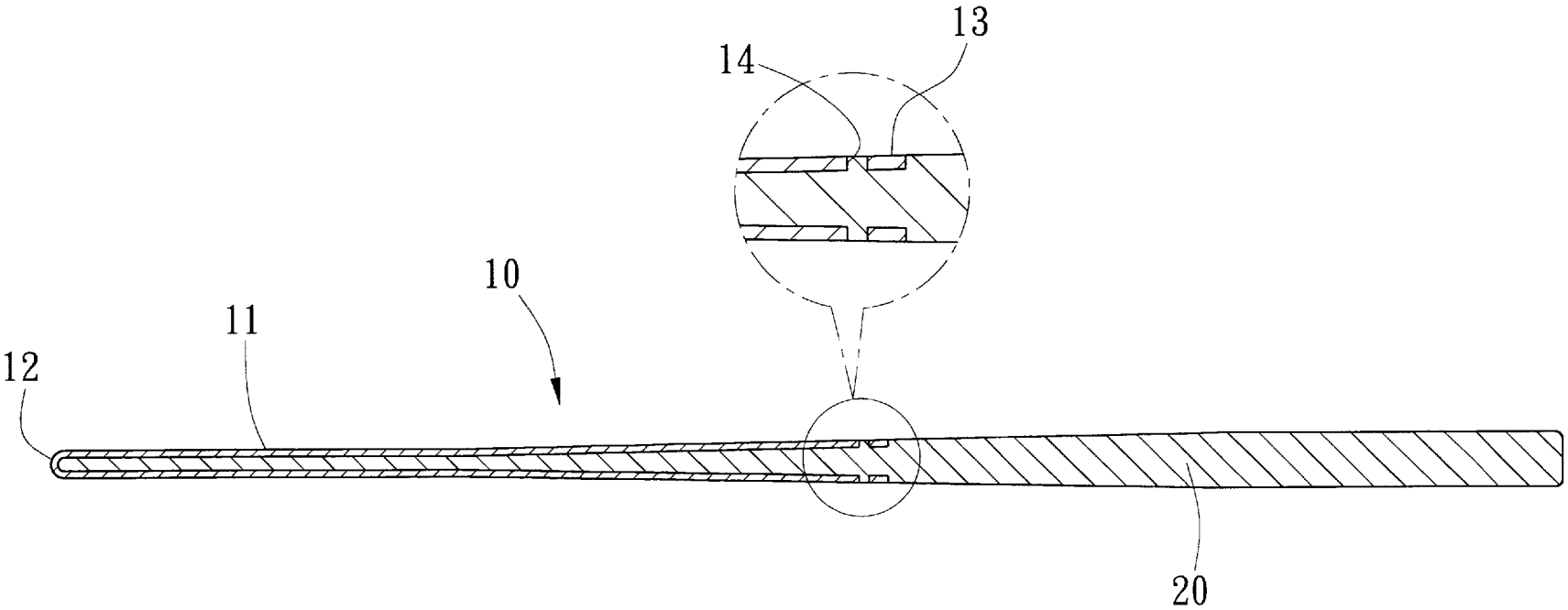
FIG. 3 is a sectional view of the present invention after assembling.

Referring firstly to FIGS. 2, 3, one of a pair of chopsticks 1 of the present invention is comprised of a stainless steel sleeve portion 10 and a main body 20 combined with each other in injection molding, the stainless steel sleeve portion 10 is generally conical, at least the front section thereof has a non-smooth surface, and the front tip thereof is a rounded tip 12; an opening 13 of the sleeve portion 10 is flared, the sleeve portion 10 has a tapered section "B" including the flared opening 13 and being integrally connected with a clamping section "C" with a uniform diameter extending rearwards from the rounded tip 12. The flared opening 13 is provided on the periphery thereof with at least one hole 14.

The stainless steel sleeve portion 10 is placed in a die, and material such as nylon, PP, ABS, melamine, glazed material or plastic) is injected into the die to form the main body 20, the material injected into the die fills the flared opening 13 of the sleeve portion 10 and the abovementioned at least one hole 14, thereby, the sleeve portion 10 is firmly combined with the main body 20.

Figure 4:
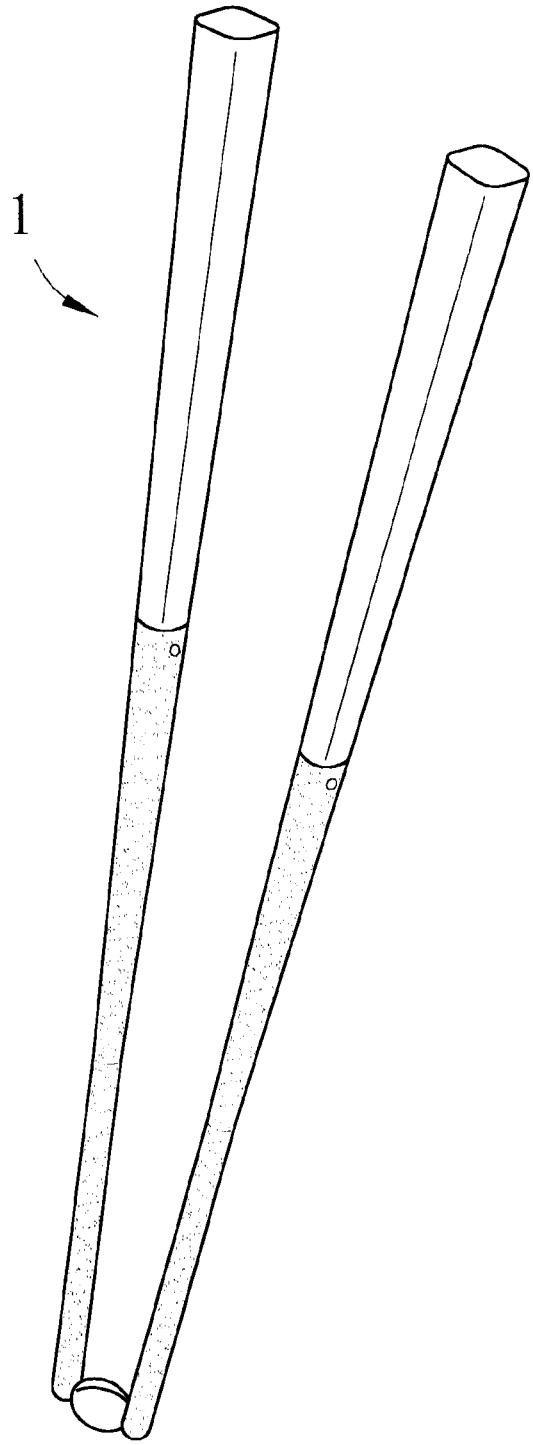
FIG. 4 is a schematic view showing use of the embodiment of the present invention.

Referring to FIG. 4, when in using the chopsticks 1 of the present invention, by the fact that the front section of any of the chopsticks 1 is a non-smooth surface 11, the front section can effectively increase friction force in picking up food; when the pair of chopsticks 1 are picking up food, they hold the food firm and the food is not easy to slip off.

Figure 5:
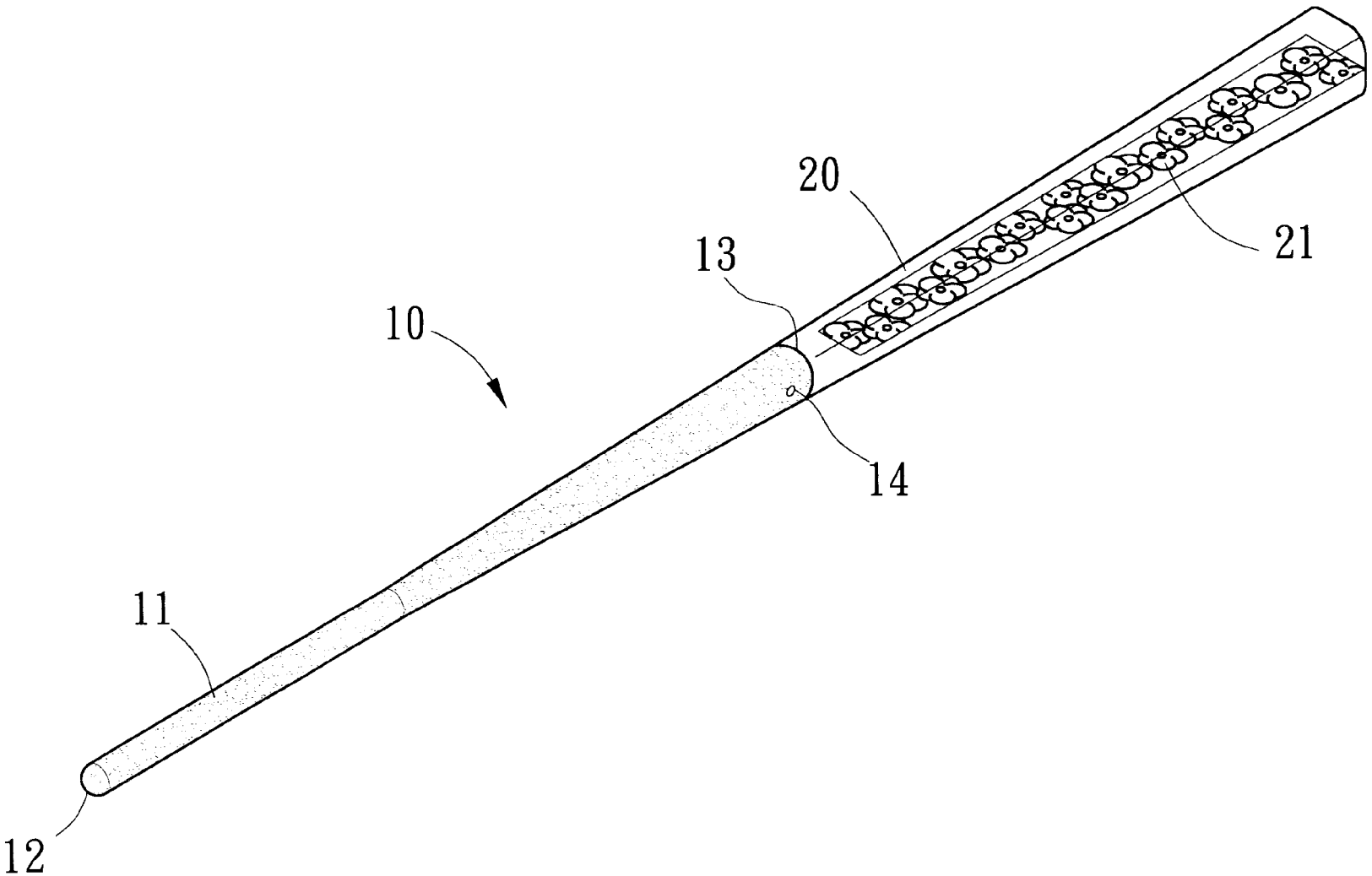
FIG. 5 is a perspective view showing application of the embodiment of the present invention.

The main body 20 of the present invention can also be made by another way, as shown in FIG. 5, a shaped sheet 21 is made by any of various processes such as screen printing or etching or laser carving etc., the shaped sheet 21 is provided with a pattern thereon and can be vacuum enveloped in transparent plastic material when it is placed in the die during forming the main body 20, thereby, the main body 20 can give elevated feeling of quality, feeling of beauty as well as be interested.

Figure 6:
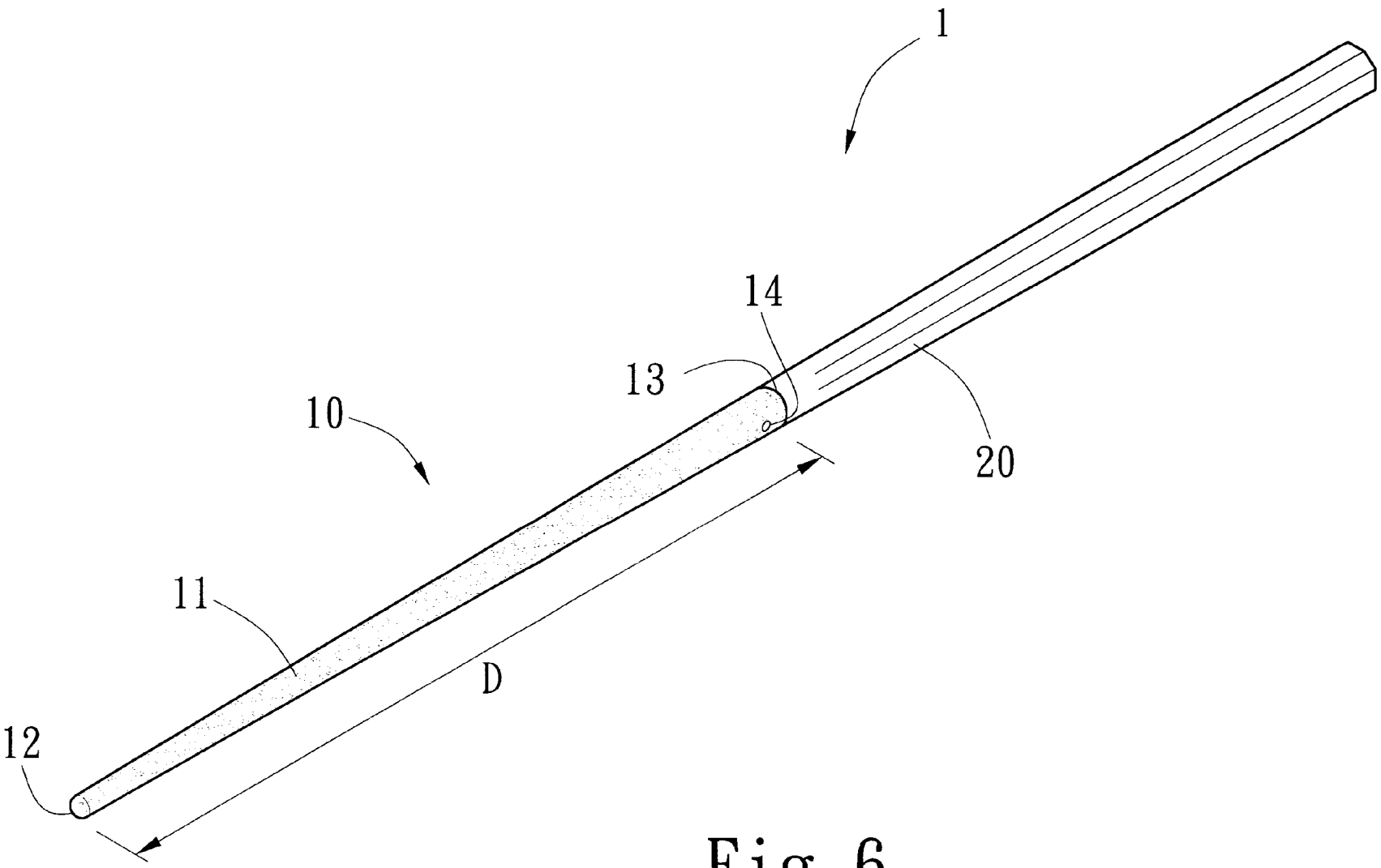
FIG. 6 is a perspective view showing the appearance of another embodiment of the present invention.

And more, the clamping section "C" of the stainless steel sleeve portion 10 of the present invention can be of a tapered section tapering along with the tapered section "B" starting from the flared opening 13, hence the stainless steel sleeve portion 10 forms a tapered clamping section "D" as shown in FIG. 6; thereby, the diameter of the entire chopstick 1 is changed gradually from the smallest one to the largest one to make a consistence of changing.

The stainless steel composite chopstick of the present invention has the following advantages:

1. The holes provided on the peripheral wall at the opening of the stainless steel sleeve portion can firmly combine the two kinds of materials for the chopstick, and can effectively get rid of the probability of loosening and dropping when the stainless steel sleeve portion and the main body are used for a period of time, rather, this can strengthen and harden the chopstick.
2. The length of the stainless steel sleeve portion is about ½ of the entire chopstick, hence the point of force bearing of the entire chopstick is not located in the thinner rod portion, thereby, the chopstick is not subjected to breaking by unsuitable exerting of a force as is the case of a conventional chopstick.
3. The main body can be made of any of various materials such as nylon, PP, ABS, melamine, glazed material, plastic or the like, or can be made to have a pattern, which shaped sheet can be enveloped in transparent plastic material to give the chopstick a beautiful appearance.

In conclusion, the above stated structure of any of a pair of stainless steel composite chopsticks can surely make the entire chopstick made of different materials firmer in combining and can reduce the bearing force on the thinner section thereof.

My invention may assume numerous forms and is to be construed as including all modifications and variations falling within the scope of the appended claims.

What is claimed is:

1. A stainless steel composite chopstick, said chopstick is comprised of a stainless steel sleeve portion and a main body combined with each other in injection molding; and is characterized by: said sleeve portion has a flared opening in connecting with said main body; said opening is located nearly at the middle of the length of said chopstick to be formed, and is provided on the periphery thereof with at least one hole for combining during fabricating said main body by injection molding.

* * * * *